United States Patent [19]

Tomkinson et al.

[11] Patent Number: 4,879,805

[45] Date of Patent: Nov. 14, 1989

[54] METHOD FOR MAKING A CIRCUIT INTERRUPTER DEVICE

[75] Inventors: Donald Tomkinson, North Attleboro; John R. D'Entremont, Foxboro, both of Mass.

[73] Assignee: Texas Instruments Incorporated, Dallas, Tex.

[21] Appl. No.: 233,392

[22] Filed: Aug. 18, 1988

Related U.S. Application Data

[62] Division of Ser. No. 44,866, Apr. 30, 1987, Pat. No. 4,780,698.

[51] Int. Cl.[4] ..... H01H 11/06

[52] U.S. Cl. ..... 29/622; 29/623; 29/418; 228/179; 264/272.11

[58] Field of Search ..... 29/623, 418, 622; 264/271.1, 272.11, 272.18; 337/112, 113, 372, 380, 381; 228/179

[56] References Cited

U.S. PATENT DOCUMENTS 4,675,990 6/1987 Viola et al. ..... 29/623

*Primary Examiner*—P. W. Echols

*Attorney, Agent, or Firm*—James P. McAndrews; John A. Haug; Melvin Sharp

[57] ABSTRACT

A resettable, current-responsive, circuit interrupter device is made by blanking two wide but thin terminals and carrier stubs therefore, and embedding them up to a substantial part of their thickness in a side wall of an insulating housing so that sides of the embedded terminal portions are exposed from the housing material along the side wall inside the housing, so that terminal ends extend from the bottom of the housing to be connected in a circuit and through the top of the housing to be accessible for test purposes. An electrical contact is secured on an exposed side surface of one embedded terminal portion and a thermostatic strip element is secured to an exposed side surface of the other embedded terminal portion to extend closely along the one housing side to normally engage the contact in a very compact, closed circuit position of the device. The thermostatic strip element has a selected resistivity and the wide terminals have substantial current capacity so the thermostatic strip self-heats to a selected temperature to open the circuit in response to occurrence of a precisely predetermined overload current condition in the device circuit at any ambient temperature likely to be encountered in an automotive environment. The corner portions are then blanked from the terminals. A lid is disposed to overlie the thermostatic strip element.

5 Claims, 4 Drawing Sheets

METHOD FOR MAKING A CIRCUIT INTERRUPTER DEVICE

This application is a division of application Ser. No. 044,866, filed Apr. 30, 1987, now U.S. Pat. No. 4,780,698.

BACKGROUND OF THE INVENTION

The field of this invention is that of devices for interrupting an electrical circuit in response to the occurrence of an overload current in the circuit, and the invention relates more particularly to low cost, resettable, current-responsive circuit interrupting devices which are sufficiently compact to be accommodated in an automotive fuse block in substitution for fuses for protecting an automotive electrical system.

Automotive electrical systems typically include one or more fuse blocks to accommodate the relatively large number of fuses necessary for protecting different portions of the circuit against current overloads. In one desirable fuse block arrangement, fuse terminals and an integral fuse element connecting the terminals are blanked from a flat metal strip and enclosed in a thin wafer-like housing. A large number of such thin fuses can be very compactly accommodated in slot-like openings in a small fuse block to provide on-shot protection for automotive circuits by interrupting the circuits in response to occurrence of selected current overloads. The fuses provide good response over the wide range of ambient temperatures encountered in the automotive environment, are manufactured at low cost, are easily adapted to provide desired high current capacity, are very compactly accommodated in a fuse block, and also permit convenient diagnostic testing of the circuits via the fuse terminals. Resettable circuit interrupter devices or circuit breakers have been proposed for performing this protective function for automotive circuits but previously known circuit breakers intended for this purpose have been expensive and bulky and have usually required separate discrete connection into each portion of the automotive circuit to be protected. It would be desirable if circuit interrupter devices used to protect some of those automotive circuits were resettable for restoring the circuit functions after a fault condition has been corrected or to permit the circuit to operate at least intermittently for safety purposes for example until action can be taken to correct a fault condition, particularly if such circuit interrupting devices could be made at sufficiently low cost and could be compactly accommodated in existing automotive fuse blocks or the like in substitution for known fuses.

BRIEF SUMMARY OF THE INVENTION

It is an object of this invention to provide a novel and improved circuit interrupter device; to provide such a device which is resettable; to provide such a device which is particularly adapted for low cost manufacture; to provide such a device which is adapted to be very compactly accommodated in an automotive fuse block; to provide such a circuit interrupter device which is adapted to be accommodated interchangeably with known, compact, wafer-like fuse structures; to provide such circuit interrupters which are adapted to operate in response to precisely predetermined current overload conditions for protecting the circuits against overload currents and the like in the various ambient temperatures likely to be encountered in automotive environments; to provide such circuit interrupters which are automatically resettable; to provide such circuit interrupters which are selectively resettable; and to provide novel and approved methods for making such circuit interrupter devices.

Briefly described, the improved resettable circuit interrupter device of this invention comprises a housing of electrical insulating material which mounts a pair of terminals in a novel way to cooperate with a thermostatic means to form a very compact device with precisely predetermined current-response characteristics at widely different ambient temperatures. Each terminal has portions thereof which are embedded in one side wall of the device housing so that side surfaces of the respective, embedded terminal portions are exposed from the housing material in spaced side-by-side relation to each other inside the housing, so that one end of each terminal extends from the bottom of the housing to be connected in an electrical circuit, and preferably so that an opposite end of each terminal extends through the top of the housing to be accessible for circuit test purposes. Preferably the terminals are relatively wide and long but very thin and are embedded up to a substantial part of their thickness in the housing side wall so the exposed side surfaces of the embedded terminal portions are substantially flush with the side wall inside the housing.

A first, stationary electrical contact means is secured to the exposed side surface of one embedded terminal portion. A thermostatic element such as a generally flat, thermostat metal strip having a dished portion thereof intermediate its ends has one end secured to the exposed side surface of the other embedded terminal portion and extends closely and compactly along the one housing side wall inside the housing to engage a movable electrical contact carried at its opposite end with the stationary contact, thereby to close an electrical circuit between the terminals. The dished portion of the thermostat metal strip element has an original curvature in its closed circuit position as described but is adapted to move with snap action to an inverted dished curvature to open the device circuit when the thermostat metal strip is heated to a predetermined actuating temperature. A housing lid is secured to the portion of the housing previously described to compactly overlie the thermostat metal strip and permit the resulting thin housing structure to be accommodated in an automotive fuse block or the like. The structure is also polarity independent to permit easy accommodation in the fuse block.

The thermostat metal strip is provided with a selected electrical resistivity and the wide but thin device terminals are adapted to provide a relatively large current-carrying capacity such that, when the device is connected in an automotive circuit in ambient temperatures which vary widely over the range encountered in automotive environments, the temperature of the thermostat metal strip is primarily determined by self-heating of the strip in response to the electrical current in the device circuit. Accordingly the device is adapted to open the device circuit in response to a precisely predetermined overload current in the circuit whether the ambient temperature is very low or very high.

In a preferred method for making the circuit interrupter device, the terminals are blanked from a thin, flat metal strip in a desired, spaced, side-by-side relation to each other and are maintained in connected relation to each other, and to other pairs of terminals blanked from the strip in sequence, by carrier portions of the strip. A first portion of the device housing is then molded onto the spaced terminals for forming the top and bottom of the housing as well as the side wall of the housing in which the terminals are embedded as above described. The first electrical contact is then formed on the exposed side surface of one embedded terminal portion, preferably in situ by a weld and coin operation, and the thermostat metal strip is welded to the exposed side surface of the other embedded terminal portion. Preferably an access opening for a resistance welding electrode is provided in said one housing side for facilitating welding of the thermostat metal strip, and preferably the thermostat metal strip is provided with a relatively long projection weld adapted to provide a long weld extending along the length of that embedded terminal portion to provide substantial current-carrying capacity at the weld location to avoid development of a hot spot at that location such as might otherwise alter the response characteristics of the device.

DESCRIPTION OF THE DRAWINGS

Other objects, advantages and details of the novel and improved circuit interrupter device and method of this invention appear in the following detailed description of preferred embodiments of the invention, the detailed description referring to the drawings in which.

DESCRIPTION OF THE PREFERRED EMBODIMENTS

Figure 3:
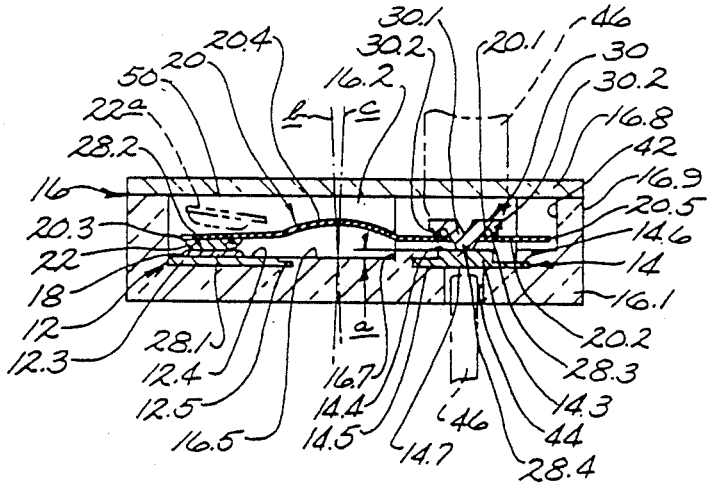
FIG. 3 is a section view along line 3—3 of FIG. 2.
Figure 4:
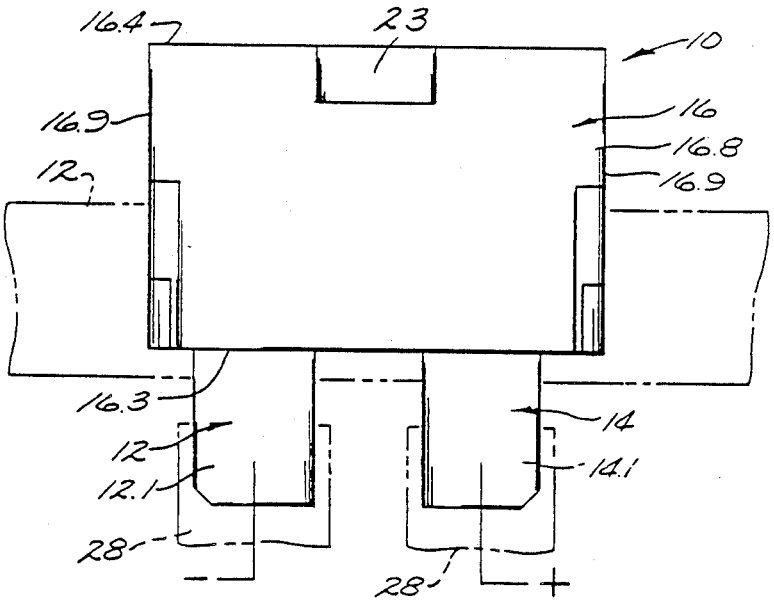
FIG. 4 is a side elevation view of the device of FIG. 2.

Referring to the drawings, 10 in FIGS. 1–4 indicates the novel and improved circuit interrupter device of this invention which is shown to include a pair of terminals 12 and 14 mounted in an electrically insulating housing 16. As shown in FIG. 3, a first or stationary electrical contact means 18 is provided on one of the terminals 12 within the housing and a thermostatic means 20 is provided on the other terminal 14 for moving a complementary, movable electrical contact means 22 into and out of engagement with the first contact means 18 to close and open an electrical circuit between the terminals in response to changes in temperature of the thermostatic means 20.

Figure 1:
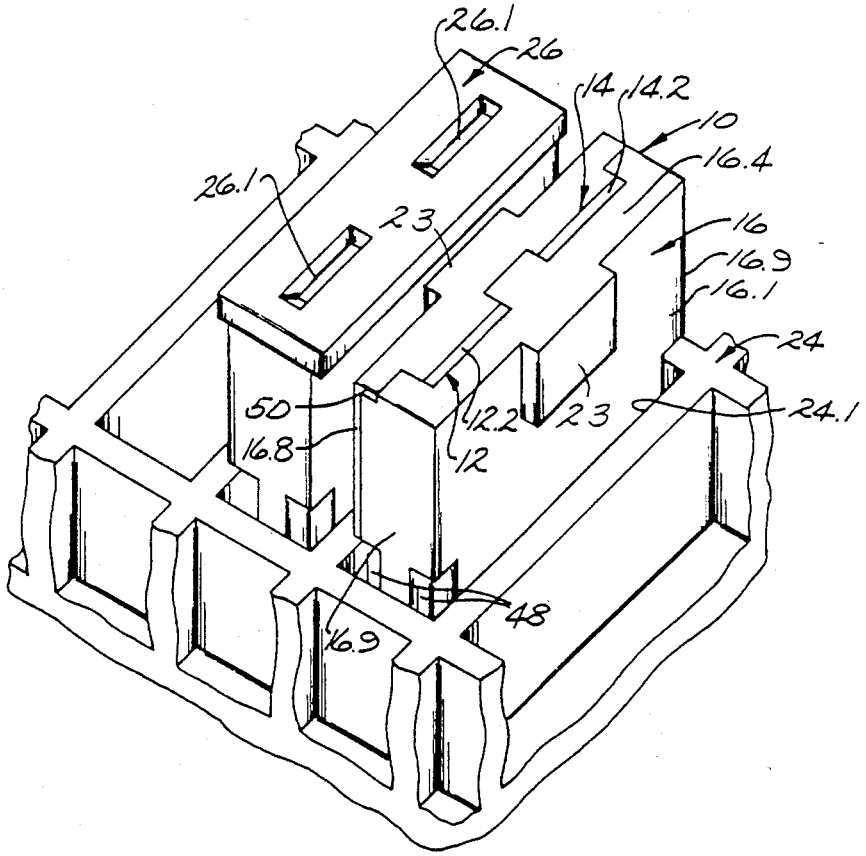
FIG. 1 is a partial perspective view of an automotive fuse block accommodating the novel and improved circuit interrupter device of this invention.
Figure 2:
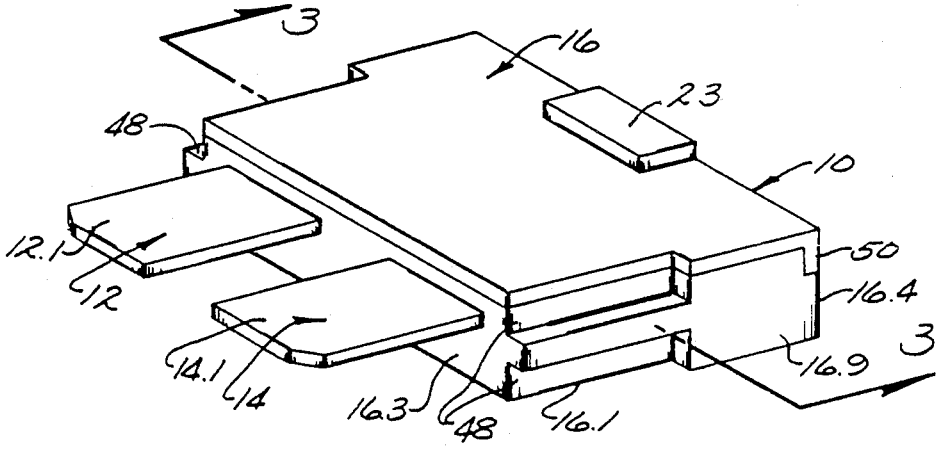
FIG. 2 is a perspective view of the circuit interrupter device of FIG. 1.

In accordance with this invention, the device 10 is provided with a novel structure to be inserted into an automotive fuse block 24 or the like as illustrated in FIG. 1 to be accommodated in a thin slot 24.1 in the fuse block interchangeably with the conventional fuses 26 which are typically used in such fuse blocks. In that regard, a conventional fuse as shown in U.S. Pat. No. 3,909,767 has a thin, wafer-like structure so that a substantial number of the fuses can be very compactly accommodated in a fuse block and each fuse has a pair of terminals (not shown) extending into the fuse block for connecting the fuse into an automotive electrical system, whereby the different fuses provide a one-shot type of overload current protection for respective portions of the automotive circuit. The conventional fuse also has openings 26.1 therein permitting access to the fuse terminals so they can be used when desired to facilitate testing of portions of the automotive circuit. The circuit interrupter device 10 of this invention has a comparably compact, thin, wafer-like structure such that it is adapted to be accommodated in a correspondingly thin slot in a fuse block while being further adapted to provide a resettable type of overload current circuit protection for respective portions of the automotive circuit. The device 10 also has terminal ends 12.1, 14.1 extending from the device to be engaged with mating connectors in the fuse block as indicated by the broken lines 27 in FIG. 4, and has opposite terminal ends 12.2, 14.2 disposed at the top of the device 10 to be accessible for circuit test purposes as illustrated in FIG. 1.

In accordance with this invention, the novel and improved structure of the device 10 is achieved by providing terminals 12 and 14 which are relatively wide and long but very thin and by providing each of the terminals with a portion 12.3, 14.3 which is embedded in one of the side walls 16.1 of the electrically insulating housing so that an upper side surface 12.4, 14.4, of each terminal (as viewed in FIG. 3) is exposed from the material of the housing within the housing chamber 16.2, so that first ends 12.1, 14.1 of the terminals pass through and extend from a second or bottom side 16.3 of the housing adjacent to said one side wall to be connected in a circuit, and so that opposite terminal ends 12.2, 14.2 extend through a third or top side 16.4 of the housing opposite the second housing side to be accessible for test purposes. Preferably the noted terminal portions are embedded in spaced side-by-side relation to each other up to a substantial portion of their thickness in the housing side wall so the exposed side surfaces 12.4, 14.4 of the embedded terminal portions are substantially flush with the inner surface of the housing side wall. In that way the terminals are very compactly accommodated in the device even though wide terminals having substantial current-carrying capacity are used. The terminals also tend to extend over a major portion of the side wall to reinforce the principal side wall of the device as will be understood. In a preferred embodiment, the embedded terminal portions 12.3, 14.3 extend in respective parallel planes at different levels such that there is a small spacing between the planes as indicated at a in FIG. 3, so that inner surfaces 16.5 and 16.6 of the housing side wall are substantially flush with the respective side surfaces 12.4, 14.4 of the terminal adjacent thereto, and so that there is a step 16.7 formed in the side between the terminals. Preferably each terminal also has a portion 12.5, 14.5 of relatively reduced thickness formed by coining or the like which is fully embedded in the material of the housing side wall 16.1 for securely locking the terminal within the side wall. Preferably also, the terminal 14 has an additional edge portion 14.6 of reduced thickness for a purpose to be described below.

In accordance with this invention, the first electrical contact 18 is preferably formed of a material such as silver or the like having high electrical conductivity and preferably a low contact surface resistance. The first contact is preferably welded to the exposed side surface 12.4 of one terminal as indicated at 28.1 in FIG. 3. The thermostatic means 20 preferably comprises a multilayer thermostat metal strip element (only one layer being shown for clarity of illustration) which is welded to the exposed side surface 14.4 of the other terminal in similar manner. Preferably for example, the thermostat metal strip has a slit 20.1 extending substantially across the width of the strip adjacent one strip end 20.2, and has the movable contact 22 formed of a similar high electrical conductivity, low contact resistance material welded to the opposite strip end 20.3 as indicated at 28.2 in FIG. 3. A weld slug 30 having a long weld projection 30.1 formed thereon and having a series of smaller weld projections 30.2 formed around the long weld projection is disposed at the end 20.3 of the thermostat metal strip so that the small weld projections 30.2 are welded to the thermostat metal strip around the slot 20.1 as indicated at 28.3 in FIG. 3 and so that the long weld projection 30.1 extends through the slit 20.1 to be welded to the terminal 14 as indicated at 28.4. In that arrangement, the thermostat metal strip 20 extends closely and compactly along the housing side wall 16.1 for normally engaging the movable contact 22 with the stationary contact 18 to close an electrical circuit between the terminals 12 and 14, the thermostat metal strip being movable in response to change in its temperature to open the circuit as will be understood. The contact pair 18 and 22 is substantially accommodated within the spacing a provided between the planes of the terminals 12 and 14, and a housing lid 16.8 is secured closely over the thermostat metal strip to facilitate insertion of the device 10 into a fuse block or the like. Preferably bosses 23 are also provided on the housing to facilitate such insertion.

In a preferred embodiment of the invention, the thermostat metal strip 20 has a dished portion 20.4 intermediate its ends, the dished portion having an original curvature as shown in FIG. 3 and being disposed with a concave side of the original dished configuration facing the housing side 16.1 when the thermostat metal strip is in its normal, closed circuit position as illustrated in FIG. 3. However the dished portion of the thermostat metal strip is adapted to move with snap action to an inverted dish curvature when the strip is heated to a predetermined actuating temperature, thereby to move the movable contact means to an open circuit position as indicated by the broken lines **22*a* in FIG. 3 as will be understood. The thermostat metal strip is adapted to return to its original curvature with snap action for resetting the device and reclosing the device circuit when the thermostat metal strip is subsequently cooled to a predetermined resetting temperature. Preferably the thermostat metal strip is disposed within the housing chamber 16.2** so that the central axis of the dished portion of the disc as indicated at *b* in FIG. 3 is disposed obliquely relative to a line *c* normal to the planes of the terminals 12 and 14 for inclining the thermostat metal strip end 20.3 toward the housing side 16 to be more compactly accommodated within the housing chamber 16.2.

In the preferred embodiment of this invention, the terminals 12 and 14 are relatively wide for providing the device with substantial current-carrying capacity and are preferably formed of a material such as copper or brass having relatively high electrical conductivity such that very little heat tends to be generated in the terminals during device operation. The weld projection 30.1 is also arranged to be very long and extend along a substantial part of the length of the embedded terminal portion 14.3 so that the substantial current can be carried through the weld 28.4 without tending to create a hot spot at the weld location. The thermostat metal strip 20 is then provided with a substantial electrical resistivity relative to the terminals 12 and 14 such that the thermostat metal strip tends to self-heat by electrical resistance heating when electrical current is directed through the device circuit and such that the temperature of the strip is primarily determined by such self-heating with little contribution from heat generated in the terminals during device operation even when the device is operated at the widely different temperatures ranging from −40 to +120 degrees C. likely to be encountered in automotive environments. In that arrangement, the device 10 is adapted to open the device circuit at precisely predetermined actuating temperatures of the thermostat metal strip in response to the occurrence of a precisely predetermined overload current in the circuit at the various ambient temperatures.

Figure 5:
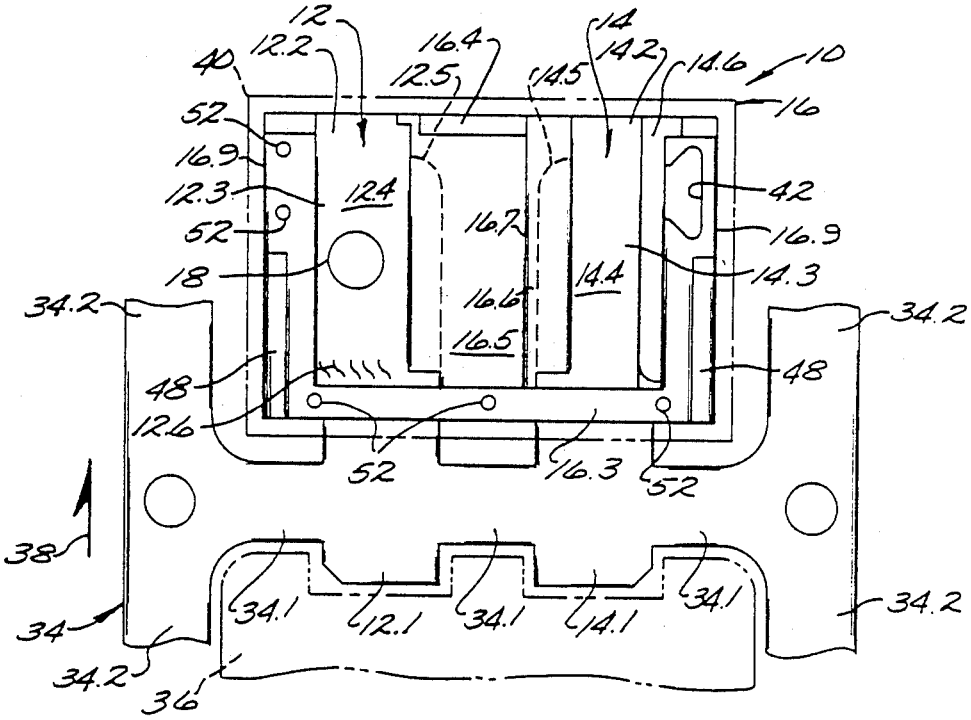
FIG. 5 is a side elevation view similar to FIG. 4 illustrating the device with the housing lid and other components removed in a stage of the method of making the device as provided by this invention.

In the preferred method of this invention for forming the circuit interrupter device 10, the pair of terminals 12 and 14 are preferably blanked from a thin, flat strip 34 of electrically conductive material such as copper, brass or steel or the like as diagrammatically indicated at 36 in FIG. 5. The pair of terminals are preferably blanked with a desired spacing therebetween, are maintained in connected relation to each other with that spacing by carrier portions 34.1 of the strip, and are held by other carrier portions 34.2 of the strip in connected relation with other pairs of terminals (not shown) which are blanked from strip in sequence as indicated by the arrow 38 in FIG. 5. Preferably the coined portions 12.5, 14.5 of the terminals and the reduced thickness portion 14.6 of one of the terminals are also formed during this blanking stage of the method and preferably the terminal portions 12.3, 14.3 are disposed in their desired spaced, parallel planes relate to each other by bending the terminal 12 during this blanking stage as indicated by the bend in the terminal 12 at 12.6 in FIG. 5.

In the method of this invention, a first portion of the housing including the side wall 16.1, the top and bottom walls 16.4, 16.3, and the lateral side walls 16.9 are molded around the terminals 12 and 14 by injection molding or the like as is diagrammatically indicated by the mold means 40 in FIG. 5, thereby to embed the terminal portions 12.3, 14.3 in the side wall 16.1 and to extend the terminal end through the top and bottom side walls 16.4, 16.3 of the housing as above described. Preferably one of the lateral housing walls 16.9 adjacent to the terminal 14 is provided with a key-shaped slot 42 during the molding stage as illustrated in FIG. 5 and preferably the housing side wall 16.1 is provided with a molded weld-electrode access opening 44 extending along the back side 14.7 of the terminal 14 as is best shown in FIG. 3. In a preferred embodiment of the invention, the housing is molded of polytetraphthalate material or the like providing the housing with a rigid, strong structure suitably attached to the terminals 12 and 14 embedded therein. However other known electrically insulating housing materials are also used within the scope of this invention.

Figure 6:
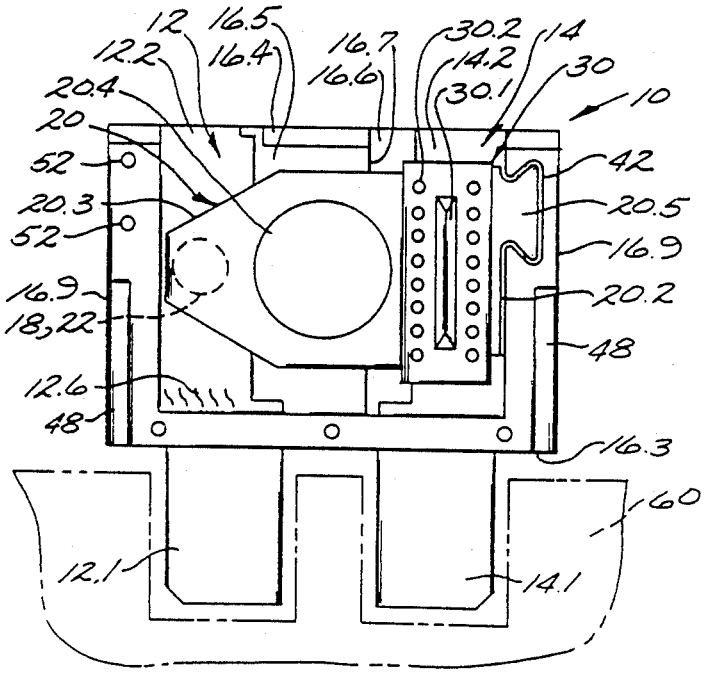
FIG. 6 is a side elevation view similar to FIG. 5 illustrating the device with additional components added in a further step in the method for making the device as provided by this invention.

The stationary electrical contact 18 is preferably formed in situ on the terminal 12 by use of a material of high electrical conductivity such as silver or copper or the like by use of a conventional wire welding and coining technique and the thermostat metal strip is preferably resistance welded to the terminal 14 as is diagrammatically indicated by the weld electrodes 46 in FIG. 3. In that welding procedure, the thermostat metal strip is easily rotated about an axis defined by the line of engagement of the long weld projection 30.1 with the terminal 14 to assure that the movable contact 18 engages the contact 22 with a desired contact pressure at a selected temperature and the weld 28.4 is formed to maintain that desired contact pressure. The thermostat metal strip 20 preferably has a key-shaped locating tang 20.5 which fits within the key-shaped slot 42 in the housing wall to facilitate precise locating of the thermostat metals strip within the housing chamber 16.2, and the reduced thickness edge 14.6 of the terminal which supports the thermostat metal strip permits the strip to be rotated on the noted weld projection axis without interference between the terminal and the thermostat metal strip during locating and welding of the strip to the terminal. The carrier strip portions 34.1 and 34.2 are then blanked from the strip material 34 to separate the terminals 12 and 14 and the other device components secured thereto from the metal strip as is diagrammatically indicated by the blanking tool 60 in FIG. 6, thereby to form a discrete and separate device 10.

In the preferred embodiment of the invention, the side walls 16.9 of the housing are grooved as indicated at 48 to facilitate positioning within the fuse block 24. The housing cover 16.8 is preferably provided with a lip portion 50 to fit down over the terminals 12 and 14 and to cooperate with the housing top side wall portion 16.4 for closing the housing chamber 16.2. Preferably the lateral and bottom side walls of the housing having openings 52 molded therein and the housing lid 16.8 has mating projections (not shown) to fit in those openings to assure precise positioning of the lid on the housing. Preferably the lid is secured to the housing by means of an adhesive material or the like (not shown) as will be understood. In that arrangement, the novel and improved circuit interrupter device 10 is adapted for low cost, repetitive manufacture so the device is adapted for interchangeable use with low cost fuses and the like as previously described.

Figure 7:
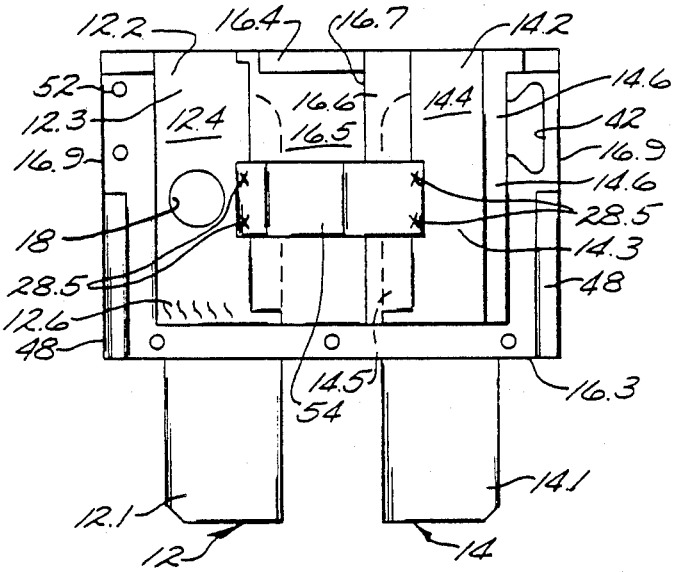
FIG. 7 is a side elevation view similar to FIG. 5 illustrating an alternate embodiment of the device and method of this invention.

In another alternate embodiment of this invention as illustrated at **10*a* in FIG. 7, wherein the same or corresponding reference numerals identify corresponding device components, an electrical resistance heater element 54 formed of an electrical resistance material such as a strip of resistive carbon deposited on a polyimide support such as Kapton or the like, preferably having a positive temperature coefficient of resistivity, has its opposite ends welded to the terminals 12 and 14 as indicated at 28.5 in FIG. 7. The heater element has selected resistivity characteristics such that, when the thermostat metal strip is in closed circuit position, the principal device current passes through the thermostat metal strip and the heating of the thermostat metal strip to its actuating temperature in response to an overload current in the circuit is primarily due to self-heat generated in the thermostat metal strip but so that, when the thermostat metal strip moves to its open circuit position as above described, a small current continues to flow in the heater element 54 sufficient to generate heat for retaining the thermostat metal strip in its open circuit position. In that arrangement, the device 10*a* is adapted to remain in open circuit position until such time as the automotive circuit is selectively de-energized by other means such as opening of the automotive ignition switch, thereby to selectively reset the device 10*a***.

Figure 8:
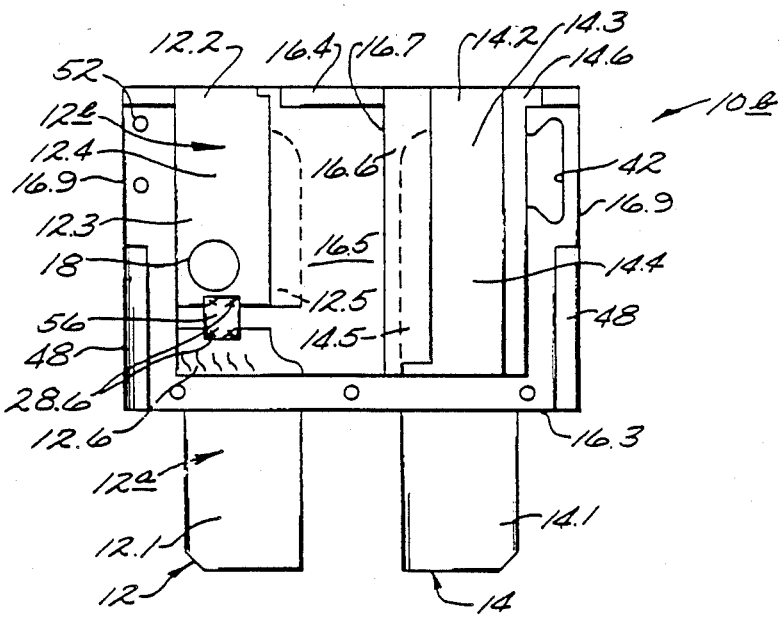
FIG. 8 is a side elevation view similar to FIG. 5 illustrating another alternate embodiment of the device and method of this invention.

In another alternate embodiment of this invention as illustrated at **10*b* in FIG. 8, the device terminal 12 is divided into separate sections 12*a* and 12*b*, and an electrical resistance heater element 56 formed of a nickel alloy material or the like is connected between those terminal sections by welding as indicated at 28.6 in FIG. 8 to be in series with those terminal sections. In this embodiment, the heater element 56** is provided with a selected electrical resistivity to generate sufficient heat during normal device operation for heating and biasing the thermostat metal strip to open the device circuit in response to occurrence of a selected overload current level as may be desired.

It should be understood that although particular embodiments of this invention have been described by way of illustrating the invention, the invention includes all modifications and equivalents of the disclosed embodiments following within the scope of the appended claims.

I claim:

1. A method for making a circuit interrupter device comprising the steps of blanking a pair of terminals from a flat metal strip in selected spaced relation to each other and blanking carrier portions of the strip connected to the terminals for temporarily maintaining the terminals in said spaced relation, molding an electrically insulating housing around the terminals including a first housing side having selected portions of the terminals embedded therein so that respective side surfaces of the embedded terminal portions are exposed from the housing material at said one housing side and including a second housing side adjacent said one housing side having ends of the respective terminals extending through said second housing side, securing first contact means to the exposed side surface of the embedded portion of one of the terminals, securing a thermostat metal element having movable contact means thereon to the exposed side surface of the embedded portion of the other of said terminals so that the thermostat metal element extends closely along said one housing side for moving the movable contact means into and out of engagement with the first contact means in response to occurrence of selected thermostat element temperatures, and blanking the carrier portions of the flat metal strip from the terminals to leave the terminals supported in the housing material molded thereon.

2. A method according to claim 1 wherein a lid is secured to the molded housing material in closely overlying relation to the thermostat metal element.

3. A method according to claim 2 wherein the thermostat metal element has a relatively long and narrow projection weld means thereon adjacent one end thereof and has said movable contact means mounted at an opposite end of the thermostat metal element, the projection weld is engaged with the exposed side surface of the embedded portion of said other terminal with the projection extending along a line of engagement with the length of the embedded terminal portion, the thermostat metal element is rotated around that line of engagement for engaging the movable contact means with the first contact means with selected contact force, and the thermostat metal element is resistance welded to the other terminal along said line of engagement for securing the thermostat element in position with that desired contact force.

4. A method according to claim 2, wherein the housing is molded to have a key-shaped slot in a side thereof adjacent the embedded portion of said other terminal, the thermostat metal element has a key-shaped tang extending from said one end thereof and the tang is movably disposed in said key-shaped slot for selectively positioning the thermostat metal element with said weld projection extending along a selected part of the length of the embedded portion of the other terminal prior to welding of the thermostat metal element to said other terminal.

5. A method for making a condition responsive device comprising the steps of providing a pair of elements in spaced relation on a base, securing first contact means to one of the base elements, providing a thermostat metal element having movable contact means at one end and having a relatively long and narrow projection weld means thereon adjacent an opposite end thereof, engaging said projection weld means with the other base element with the projection weld means extending along a line of engagement with the other base element and rotating the thermostat metal element around that line of engagement for engaging the movable contact means with the first contact means with selected contact force, and resistance welding the thermostat metal element to the other base element along said line of engagement for securing the thermostat element to that other element to move the movable contact means into and out of engagement with the first contact means in response to occurrence of selected thermostat element temperatures.

* * * * *